US006120023A

United States Patent [19]

Lai

[11] Patent Number: 6,120,023

[45] Date of Patent: Sep. 19, 2000

[54] RANDOM ACCESS GAME TOY

[76] Inventor: Chang-Keng Lai, No. 8-6, Chung Ho Rd., Ta Ya Tsun, Ta Ya Hsiang, Taichung Hsien, Taiwan

[21] Appl. No.: 09/260,559

[22] Filed: Mar. 2, 1999

[51] Int. Cl.[7] ..... A63F 3/06

[52] U.S. Cl. ..... 273/144 B

[58] Field of Search ..... 273/148 R, 138.1, 273/138.3, 138.4, 144 R, 144 B

[56] References Cited

U.S. PATENT DOCUMENTS

| | | | |
|---|---|---|---|
| D. 275,972 | 10/1984 | Bahier | 273/144 B X |
| 4,403,775 | 9/1983 | Chaput | 273/144 B |
| 4,530,503 | 7/1985 | Rice | 273/144 B |
| 4,541,630 | 9/1985 | Dirks | 273/144 B |
| 5,328,172 | 7/1994 | Jagiella | 273/144 B |
| 5,702,101 | 12/1997 | Russell | 273/144 B |
| 5,725,212 | 3/1998 | Garrett | 273/144 R |

FOREIGN PATENT DOCUMENTS

| | | | |
|---|---|---|---|
| 2400738 | 4/1979 | France | 273/144 B |
| 3603302 | 8/1987 | Germany | 273/144 B |
| 2213070 | 8/1989 | United Kingdom | 273/144 B |
| 2245840 | 1/1992 | United Kingdom | 273/144 B |

*Primary Examiner*—Raleigh W. Chiu
*Attorney, Agent, or Firm*—Bacon & Thomas

[57] ABSTRACT

A random access game toy, which includes a rod member, which has a plurality of longitudinal grooves and longitudinal number bars alternatively arranged around the periphery of a top end thereof, transparent container covered on the top end of the rod member, and a set of first color balls of a first color and at least one second color ball of a second color received in the transparent container, wherein the color balls fall to the longitudinal grooves to indicate a respective number at the number bars when the rod member is held in vertical, and are received in the transparent container outside the rod member when the rod member is turned upside down.

4 Claims, 11 Drawing Sheets

RANDOM ACCESS GAME TOY

BACKGROUND OF THE INVENTION (a) Field of the Invention

The present invention relates to a game toy, and more particularly to a random access game toy in which color balls fall into longitudinal grooves at a rod member at random to indicate a respective number when played.

(b) Description of the Prior Art

When playing a game, the players may determine the order in playing the game by drawing lots. For example, the players may draw dice, and determine the order in playing the game subject to the number each player obtained in drawing dice. Roulette wheel is another game of choosing a number at random in which people bet on the turn of a table, on which a ball is set in motion, which finally drops into one of the a set of numbered compartments. These devices may be used in another game, for example, the game of "HOTEL" of becoming a rich Hotel Tycoon. Further, when in an activity of drawing a lottery or raffle, the sponsor may prepare a set of gambling slips for drawn by the participants, so as to determine the winner of every prize. However, it takes much time to prepare gambling slips. Therefore, using a machine to determine the sequence in playing a game or winner of a prize at random is a fair and efficient way.

SUMMARY OF THE INVENTION

According to one aspect of the present invention, the random access game toy comprises a rod member, which has a plurality of longitudinal grooves and longitudinal number bars alternatively arranged around the periphery of a top end thereof, transparent container covered on the top end of the rod member, and a set of first color balls of a first color and at least one second color ball of a second color received in the transparent container, wherein the color balls fall to the longitudinal grooves to indicate a respective number at the number bars when the rod member is held in vertical, and are received in the transparent container outside the rod member when the rod member is turned upside down. According to another aspect of the present invention, the transparent container can be made having a hollow, transparent barrel covered on the top end of the rod member which guides the first color balls and the at least one second color balls into the longitudinal grooves when the rod member is held in vertical, and a transparent, spherical shell formed integral with one end of the barrel which receives the first color balls and the at least one second color balls when the rod member is turned upside down. According to still another aspect of the present invention, the rod member comprises a bevel groove formed around the periphery adjacent to its top end and sealed within the transparent container, a notch at one sloping side wall of the bevel groove, and three third color balls of different colors moved between the notch and the bevel groove within the transparent container. According to still another aspect of the present invention, a writing instrument may be incorporated into the rod member, so that the players can use the writing instrument to record the result upon each turn when playing the game.

DETAILED DESCRIPTION OF THE PREFERRED EMBODIMENT

Figure 1:
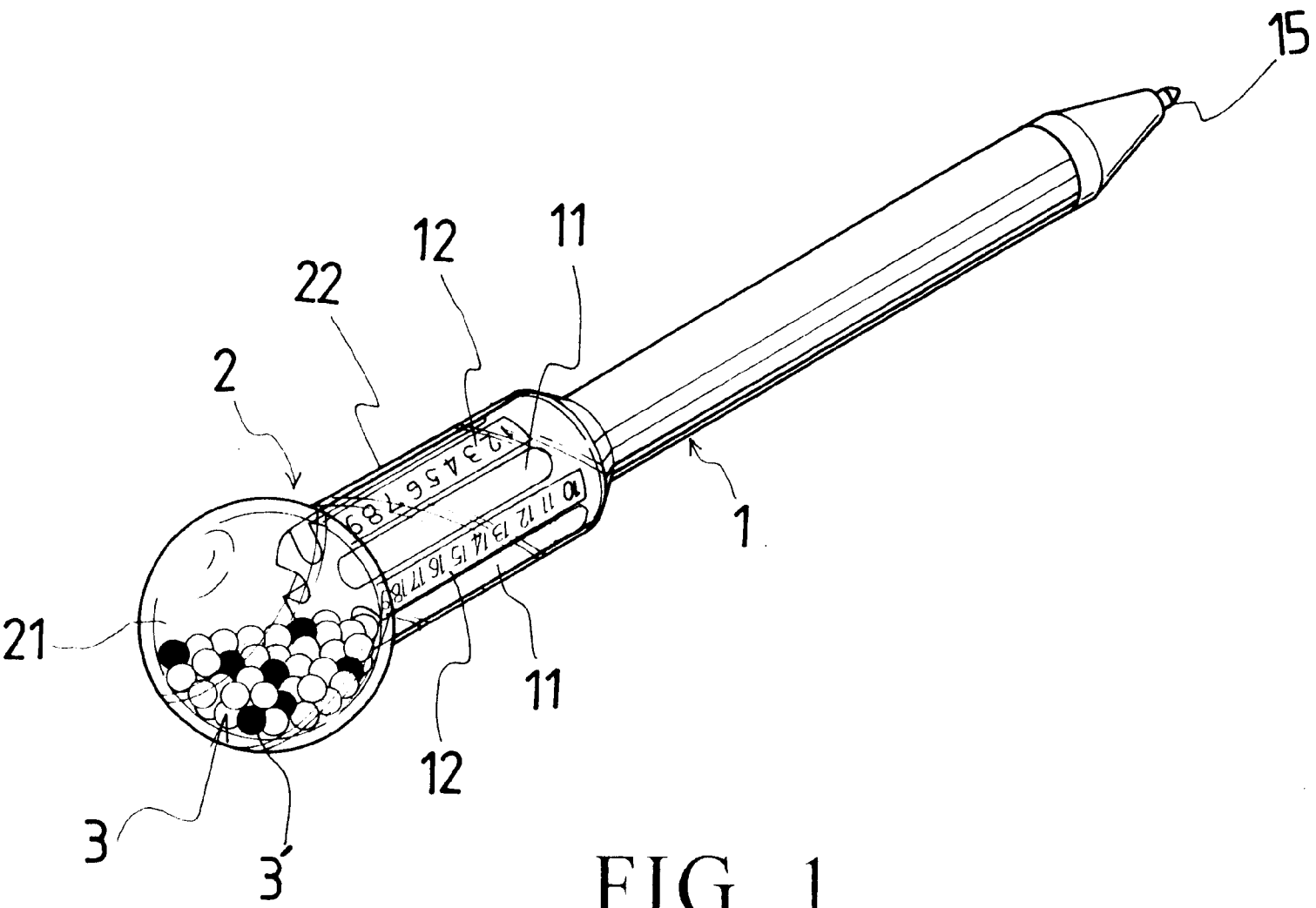
FIG. 1 is a perspective view of a random access game toy according to one embodiment of the present invention.

Referring to FIG. 1, a random access game toy is shown comprised of a rod member 1, a container 2, and color balls 3 and 3'. The rod member 1 comprises a plurality of longitudinal grooves 11 and longitudinal number bars 12 alternatively arranged around the periphery at its one end (namely, the top end), and a series of numbers from 1 through n printed on the number bars 12 in proper order. The series of numbers is equal to the number of the color balls 3 and 3'. The container 2 comprises a hollow, transparent barrel 22, and a transparent, spherical shell 21 formed integral with one end of the barrel 22. The inside space of the spherical shell 21 communicates with the inside space of the barrel 22. The diameter of the spherical shell 21 is greater than that of the barrel 22. The color balls 3 and 3' are made of metal, having a diameter slightly smaller than the width of the longitudinal grooves 11. The color balls 3 and 3' include a plurality of first color balls 3 of one color, and at least one second color ball 3' of another color. When the color balls 3 and 3' matches with the longitudinal grooves 11, i.e., the longitudinal grooves 11 can be filled up with the color balls 3 and 3'.

Figure 2:
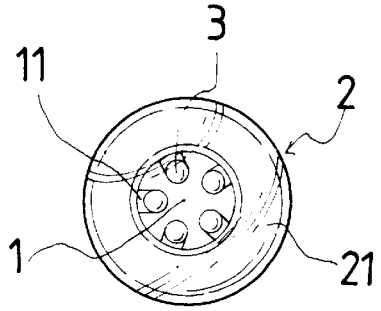
FIG. 2 is a top view of the random access game toy shown in FIG. 1.
Figure 3:
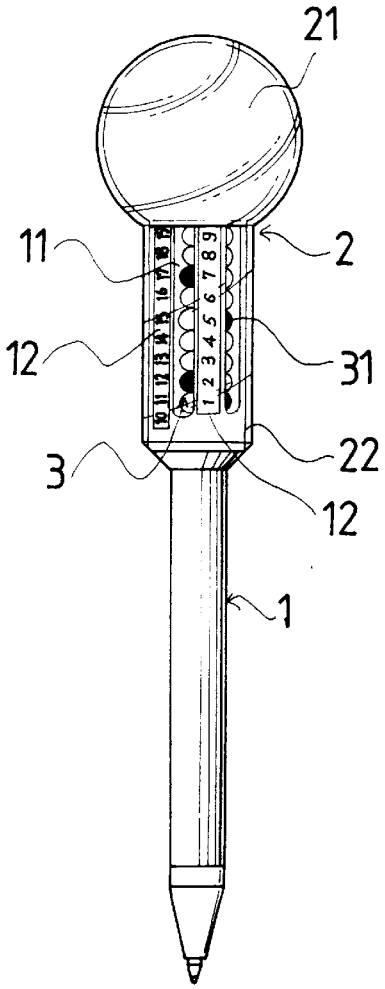
FIG. 3 is a front view of the random access game toy shown in FIG. 1.

Referring to FIGS. 2 and 3 and FIG. 1 again, the color balls 3 and 3' are put in he container 2, then the rod member 1 is press-fitted into the barrel 22 of the container 2, permitting the longitudinal grooves 11 and the longitudinal number bars 12 to be received inside the barrel 22 of the container 2. When in play, the player shakes the rod member 1 to move the color balls 3 and 3' in the spherical shell 21. When the player stops shaking the rod member 1(the random access game toy is kept in vertical with the spherical shell 21 disposed at the top side), the color balls 3 and 3' immediately fall to the longitudinal grooves 11 within the barrel 22. Through the indication of the numbers at the number bars 12, the score is calculated subject to the location of the second color ball 3'. Because the color balls 3 and 3' fall to the longitudinal grooves 11 at random, the players cannot control the game in advance. A prize can be given to the player who achieve placing the second color ball 3' in the longitudinal grooves 11 in the position corresponding to a predetermined number at the number bars 12. This random access game toy can be used in any of a variety of games. For example, the random access game toy can be used in the game of "HOTEL" of becoming a rich Hotel Tycoon, to determine the number of steps to go.

The number of the longitudinal grooves 11 can be 3, 4, or 5 (see Figures from 3 through 5). However, the number of the color balls 3 and 3' must be matched with the number and length of the longitudinal grooves 11 so that the color balls 3 and 3' can fill up the longitudinal grooves 11. In the embodiment shown in FIG. 1, the number of the longitudinal grooves 11 is 5, and the number of the color balls 3 and 3' is 49. This design enables each of four of the longitudinal grooves 11 to be filled up with 10 pieces of the color balls 3 and 3' , and the other longitudinal groove 11 to be filled up with 9 piece of the color balls 3 and 3'. However, the length of the longitudinal grooves 11 and the number of the color balls 3 and 3' can be relatively changed.

Figure 4:
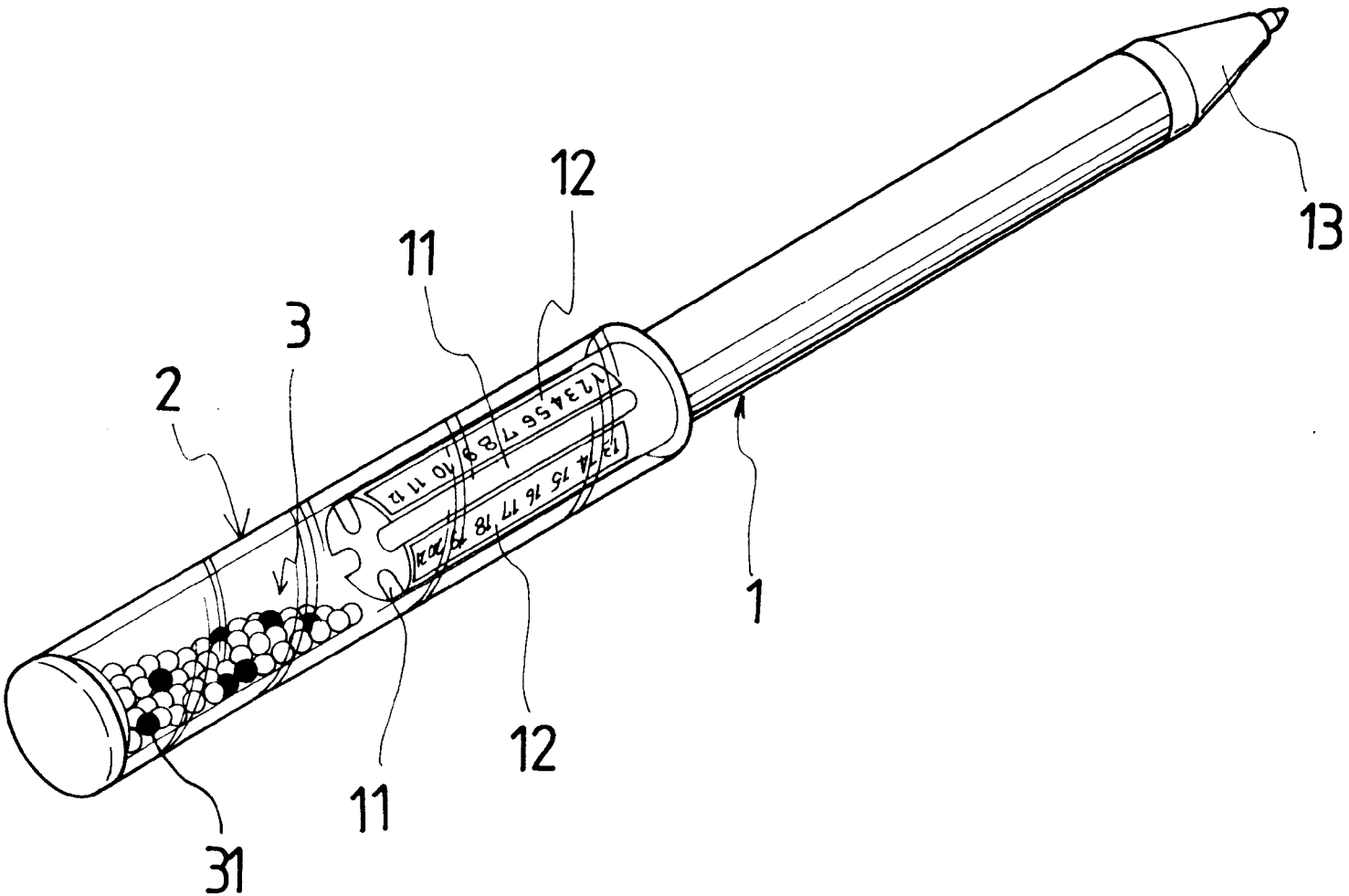
FIG. 4 is a perspective view of an alternate form of the random access game toy according to the present invention.
Figure 5:
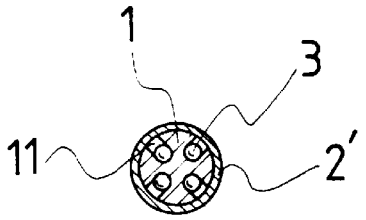
FIG. 5 is a top view of the random access game toy shown in FIG. 4.
Figure 6:
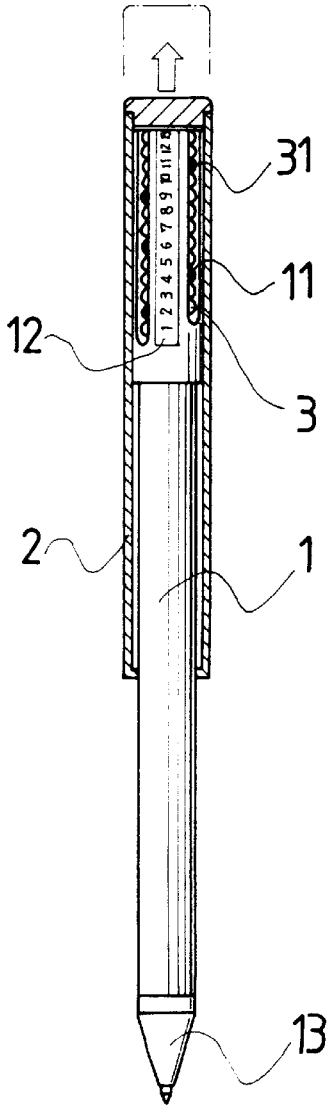
FIG. 6 is a front view in section of the random access game toy shown in FIG. 4, showing the moving direction of the sleeve-like transparent container.
Figure 7:
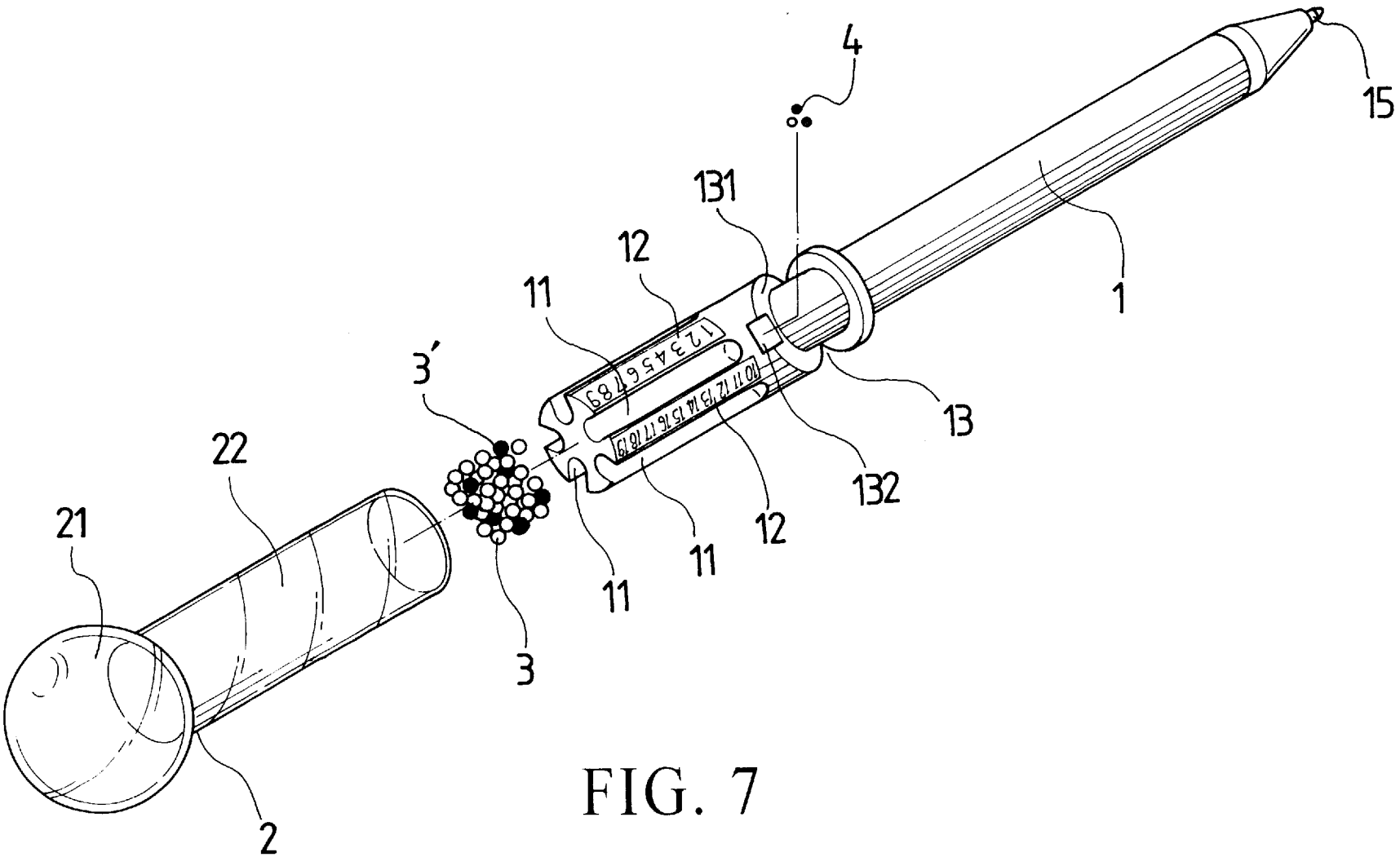
FIG. 7 is an exploded view of another alternate form of the random access game toy according to the present invention.
Figure 8:
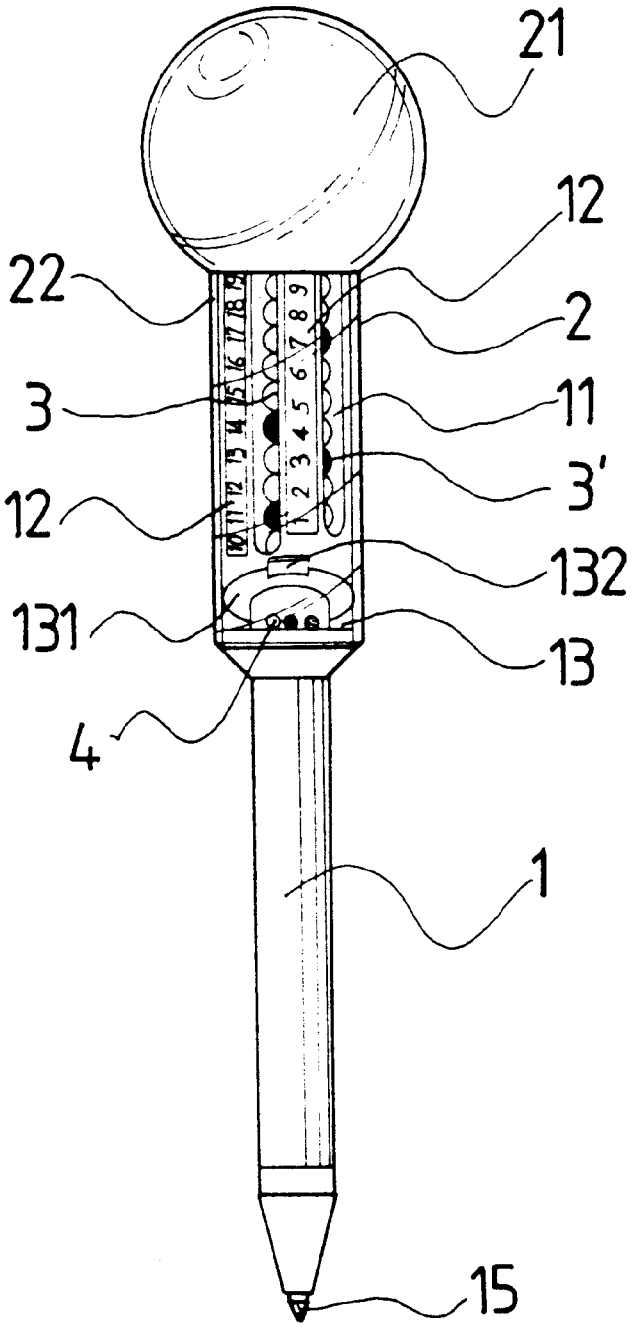
FIG. 8 is a front view of the random access game toy shown in FIG. 7.
Figure 9:
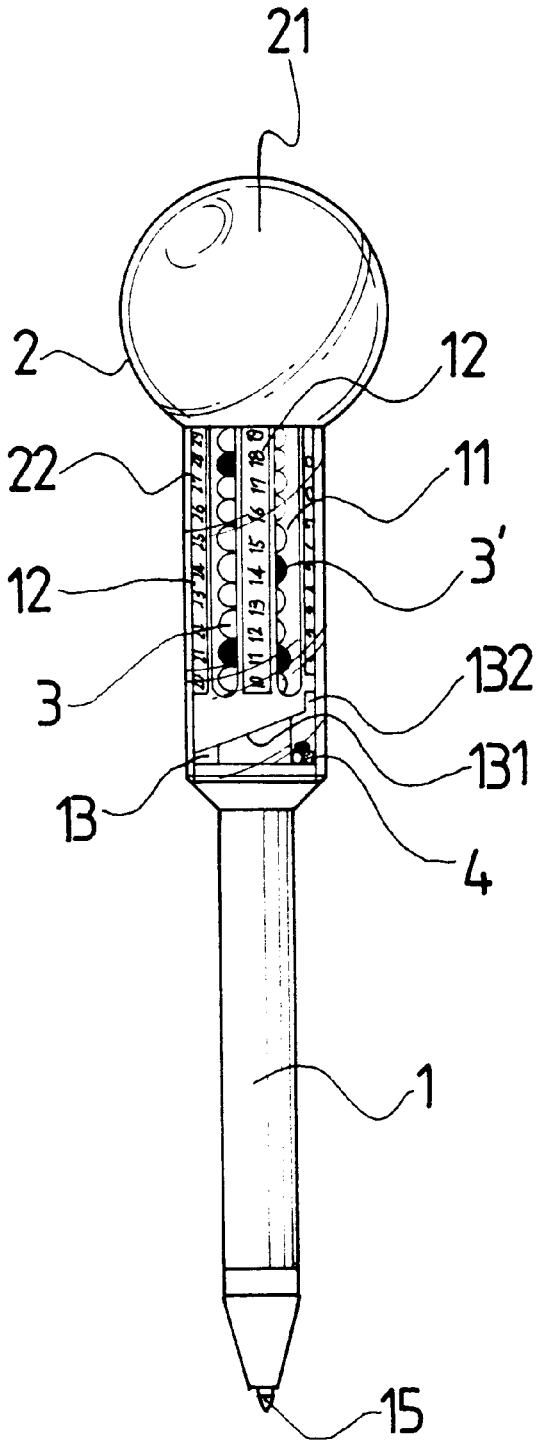
FIG. 9 is a side view of the random access game toy shown in FIG. 7.
Figure 10:
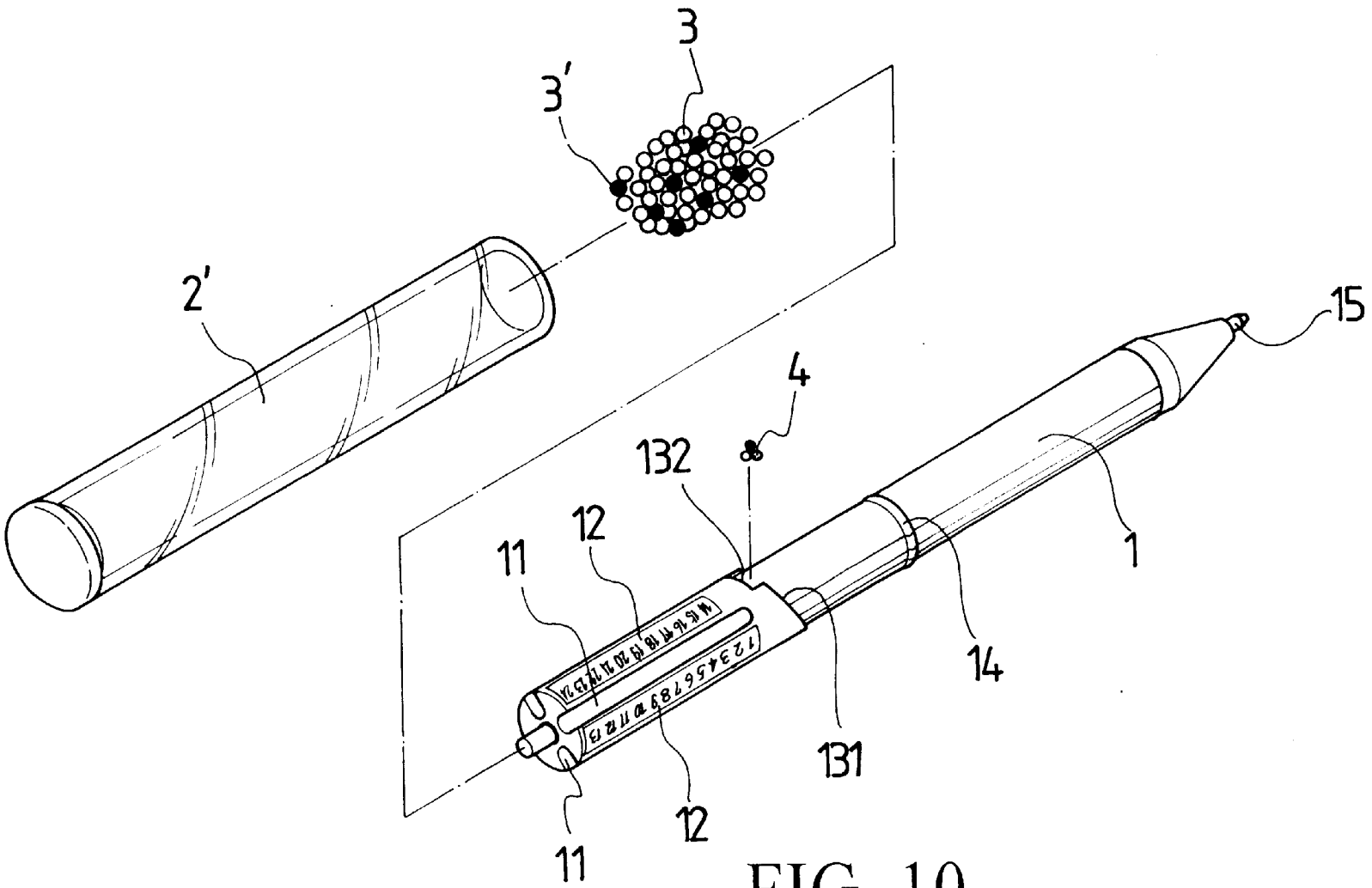
FIG. 10 is an exploded view of still another alternate form of the random access game toy according to the present invention.
Figure 11:
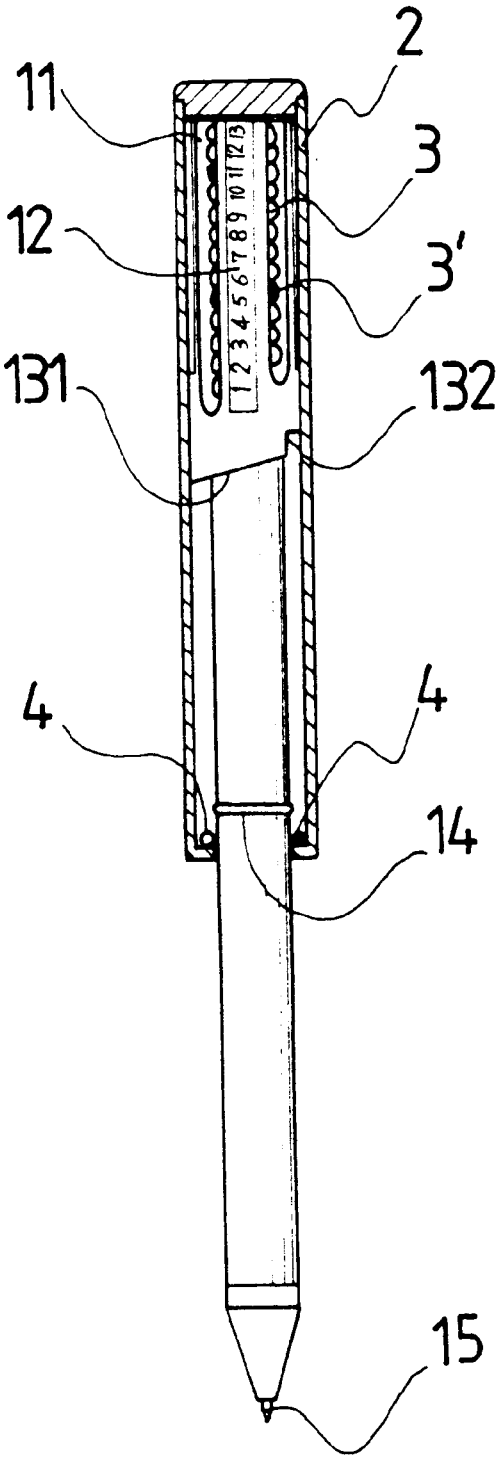
FIG. 11 is a front view in section of the random access game toy shown in FIG. 10.
Figure 12:
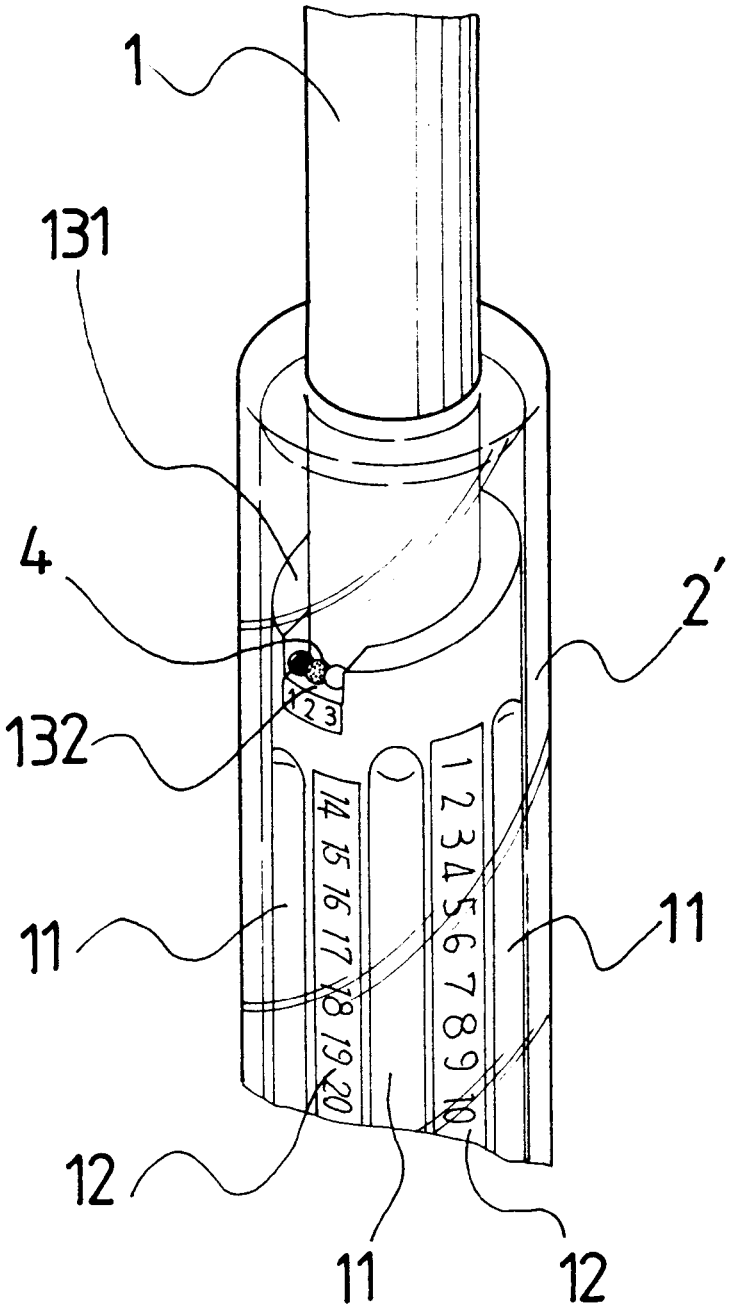
FIG. 12 is an enlarged view of a part of the random access game toy shown in FIG. 10, showing the random access game toy turned upside-down.

Figures from 4 through 6, the container 2' can be shaped like a sleeve having one end opened and the other end closed. The sleeve-like container 2' is longitudinally slidably sleeved onto one end of the rod member 1, and moved between a first position where a receiving space is defined within the sleeve-like container 2' for receiving the color balls 3 and 3' (see FIG. 4), and a second position where the color balls 3 and 3' are forced into the longitudinal grooves 11 at the rod member 1 (see FIG. 6).

Figure 13:
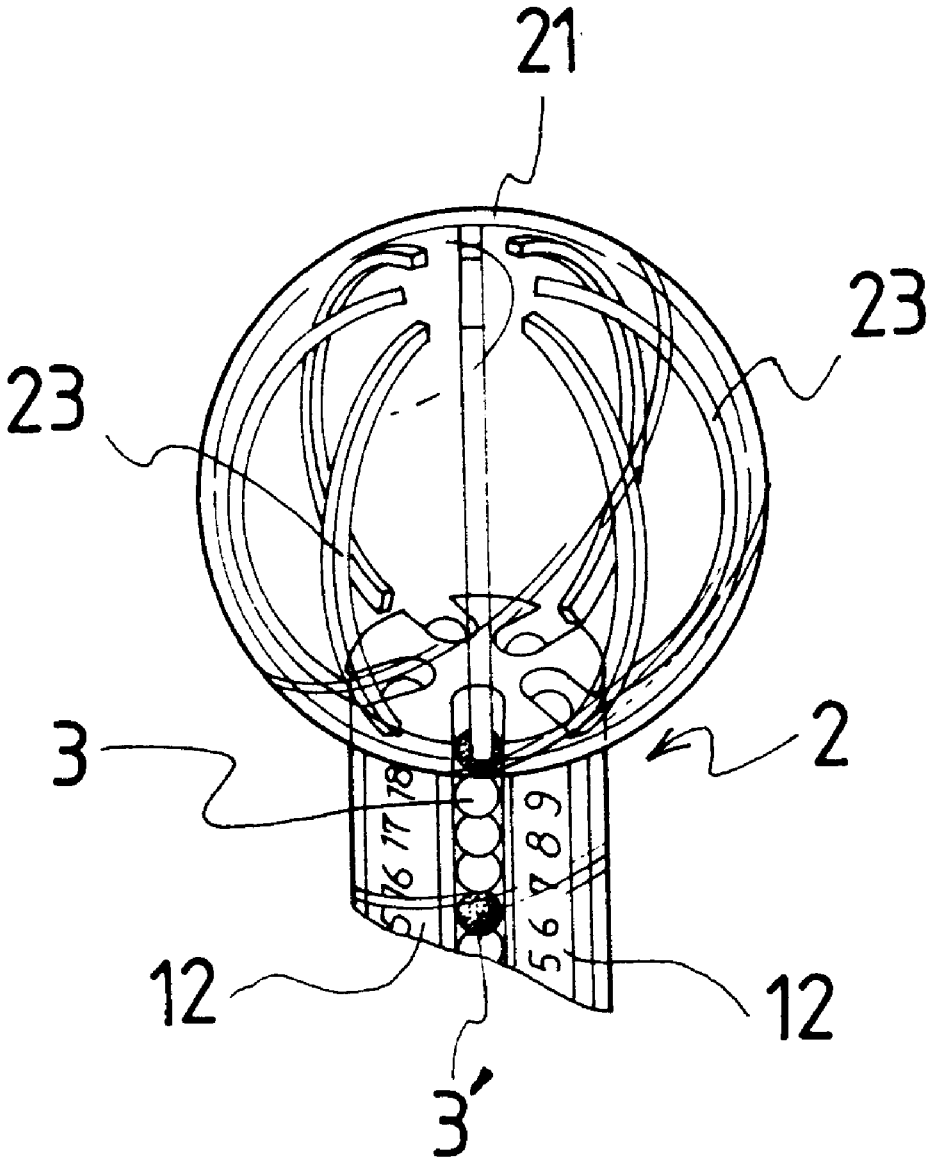
FIG. 13 is an enlarged view of a part of still another alternate form of the present invention, showing ribs provided at the transparent spherical shell of the transparent container on the inside.

Referring to FIG. 13, inside ribs 23 may be formed integral with the inside wall of the spherical shell 21 of the container 2. This design enables the color balls 3 and 3' to be evenly distributed in the container 2 when the player shakes the random game toy.

Referring to Figures from 7 through 12, a bevel groove 13 is made around the periphery of the rod member 1 and sealed within the container 2, a notch 132 is formed at one sloping wall 131 of the bevel groove 13 inside the container 2, and three third color balls 4 of different colors are put in the bevel groove 13. When the random access game toy is turned upside down and maintained in vertical, the third color balls 4 fall to the notch 132 and maintained in an order. Subject to the combination of the third color balls 4 in the notch 132, the order of the players is determined.

Furthermore, a writing instrument 15 may be incorporated into the rod member 1. The writing instrument 15 can be ballpoint pen, a fountain pen, or a pencil.

What the invention claimed is:

1. A random access game toy, comprising:

a rod member, said rod member comprising a plurality of longitudinal grooves and longitudinal number bars alternatively arranged around the periphery of a top end thereof, and a series of numbers printed on said number bars;

a transparent container arranged on the top end of said rod member;

a plurality of first color balls of a first color and at least one second color ball of a second color received in said transparent container; and a bevel groove formed around the periphery of said rod member adjacent to the top end of said rod member and sealed within said transparent container, a notch formed at one sloging side wall of said bevel groove, and three third color balls of different colors moved between said notch and said bevel groove within said transparent container;

wherein said first color balls and said at least one second color balls fall into said longitudinal grooves and indicate a respective number at said number bars when said rod member is held vertical, and said first and second color balls are received in said transparent container outside said rod member when said rod member is turned upside down.

2. The random access game toy of claim 1 wherein said transparent container comprises a hollow, transparent barrel covered on the top end of said rod member which guides said first color balls and said at least one second color balls into said longitudinal grooves when said rod member is held vertical, and a transparent, spherical shell formed integral with one end of said barrel which receives said first color balls and said at least one second color balls when said rod member is turned upside down.

3. The random access game toy of claim 2 wherein said transparent, spherical shell of said transparent container comprises a plurality of ribs equiangularly spaced on the inside.

4. The random access game toy of claim 1 wherein said rod member has a bottom end mounted with a writing instrument.

* * * * *